US007749335B2

(12) United States Patent
Simmons et al.

(10) Patent No.: US 7,749,335 B2
(45) Date of Patent: Jul. 6, 2010

(54) DISPENSER RINSE SYSTEM FOR A DRAWER-TYPE DISHWASHER

(75) Inventors: Michael C. Simmons, Moscow, TN (US); Jeffrey N. Williams, Jackson, TN (US)

(73) Assignee: Maytag Corporation, Benton Harbor, MI (US)

( * ) Notice: Subject to any disclaimer, the term of this patent is extended or adjusted under 35 U.S.C. 154(b) by 935 days.

(21) Appl. No.: 11/485,374

(22) Filed: Jul. 13, 2006

(65) Prior Publication Data

US 2007/0246077 A1 Oct. 25, 2007

Related U.S. Application Data

(60) Provisional application No. 60/793,244, filed on Apr. 20, 2006.

(51) Int. Cl.

| | |
|---|---|
| ***B08B 3/02*** | (2006.01) |
| ***B08B 3/04*** | (2006.01) |
| ***B08B 9/28*** | (2006.01) |
| ***B08B 13/00*** | (2006.01) |

(52) U.S. Cl. ..... 134/56 D; 134/104.1; 134/182; 134/198

(58) Field of Classification Search ..... 134/56 D, 134/58 D, 182

See application file for complete search history.

(56) References Cited

U.S. PATENT DOCUMENTS

| | | | | |
|---|---|---|---|---|
| 2,236,791 | A * | 4/1941 | Forsberg | 134/183 |
| 2,448,490 | A | 8/1948 | Karlstrom | |
| 3,903,911 | A | 9/1975 | Guth | |
| 5,685,178 | A | 11/1997 | Ahn | |
| 6,189,551 | B1 | 2/2001 | Sargeant et al. | |
| 6,447,081 | B1 | 9/2002 | Sargeant et al. | |
| 2005/0066998 | A1 | 3/2005 | Palm et al. | |

FOREIGN PATENT DOCUMENTS

| | | | |
|---|---|---|---|
| DE | 3620900 | A1 | 12/1987 |
| GB | 2306301 | A | 5/1997 |
| WO | 98/33426 | A1 | 8/1998 |
| WO | 2006/069827 | A1 | 7/2006 |

* cited by examiner

*Primary Examiner*—Michael Kornakov
*Assistant Examiner*—Natasha Campbell
(74) *Attorney, Agent, or Firm*—John W. Morrison; Diederiks & Whitelaw PLC

(57) ABSTRACT

A drawer-type dishwasher includes a tub having front, rear, bottom and opposing side walls that collectively define a washing chamber and a lid shiftably mounted relative to the tub for selectively closing the washing chamber. A dispenser is mounted to one of the front, rear and opposing side walls and includes a detergent storage portion that is selectively exposed to release detergent into the washing chamber. The lid includes a dispenser rinse system having an inlet portion and an outlet portion, with the outlet portion guiding a flow of water from the lid onto the dispenser to wash out the detergent storage portion and fill the washing chamber. The outlet portion is preferably provided with a shaped contour and a wall that ensures that the all detergent is washed out from the dispenser.

11 Claims, 5 Drawing Sheets

DISPENSER RINSE SYSTEM FOR A DRAWER-TYPE DISHWASHER

CROSS-REFERENCE TO RELATED APPLICATION

The present application claims the benefit of U.S. Provisional Patent Application Ser. No. 60/793,244 filed Apr. 20, 2006 entitled "Dispenser Rinse System For a Drawer-Type Dishwasher."

BACKGROUND OF THE INVENTION

1. Field of the Invention

The present invention pertains to the art of dishwashers and, more particularly, to a rinse system that directs a flow of water onto a detergent dispenser during a fill routine to wash detergent into a washing chamber.

2. Discussion of the Prior Art

In general, dishwashers having a pull-out drawer are known in the art. In some cases, the dishwasher will include an upper, pull-out drawer is forming a washing chamber for washing smaller objects such as glassware, utensils, small plates and the like, and a lower, conventional-type dishwasher. In other cases, the dishwasher will include upper and lower pull-out washing chambers, or just simply include a single pull-out type washing chamber. In any event, the pull-out washing chamber is typically provided with a dispenser that releases detergent and/or rinse aid into the washing chamber during select portions of a washing operation.

In conventional dishwashers, dispensers for detergent and rinse aid are typically located on a door assembly. At the start of a washing operation, the door assembly is opened to a substantially horizontal position, the dispenser loaded and, after loading dishes, the door assembly is closed to a substantially vertical position. During the washing operation, a mechanism opens the dispenser, allowing detergent to fall into the dishwasher. However, unlike conventional dishwashers, drawer-type dishwashers do not include a door assembly that allows loading of detergent in a horizontal orientation and dispensing in a vertical orientation.

Detergent dispensers for a drawer-type dishwasher are typically mounted to or formed in a front wall of the drawer. One dispenser design includes a pull-out chamber that is loaded with detergent. With this design, the dispenser is loaded with detergent and thereafter pivoted or pushed back into a receptacle formed in the front wall of the drawer. At a prescribed time during the washing operation, a jet of water is directed from a nozzle formed in the receptacle into the dispenser. The detergent is washed through an opening formed in a bottom of the receptacle and into the drawer. While effective, this design requires dedicated tubing to be formed into the slidable drawer during manufacturing thereby raising an overall cost and complexity of the appliance. Other designs simply allow the detergent to fall into the washing chamber under the force of gravity. While these designs minimize construction costs, often times detergent will remain in the dispenser.

Based on the above, there exists a need for a system that ensures that detergent is properly dispensed into a washing chamber of a drawer-type dishwasher. More specifically, there exists a need for a system that washes detergent from a dispenser into a washing chamber in a cost efficient and effective manner.

SUMMARY OF THE INVENTION

The present invention is directed to a dishwasher including an outer support body, a tub including front, rear, bottom and opposing side walls that collectively define a washing chamber, and a lid shiftably mounted relative to the tub for selectively closing the washing chamber. A dispenser is mounted to one of the front, rear and opposing side walls and includes a detergent storage portion that is selectively exposed to release detergent into the washing chamber. In accordance with the invention, the dishwasher includes a dispenser rinse system mounted in the lid. The dispenser rinse system directs a flow of water onto the dispenser to wash out detergent.

In accordance with the invention, the dispenser rinse system includes an inlet portion and an outlet portion The outlet portion guides a flow of water from the lid onto the dispenser to wash out the detergent storage portion and also fill the washing chamber. Preferably, the inlet portion is arranged on an outer surface of the lid and the outlet portion is arranged on an underside of the lid. The outlet portion or the underside of the lid is provided with a shaped contoured surface that directs water onto the dispenser. A wall is positioned adjacent to the outlet portion to further guide the water onto the dispenser. The wall is preferably curvilinear in shape and serves to diffuse the water flowing from the outlet section. That is, water exiting the outlet section flows over the shaped contour, impacts the wall and is diffused so as to ensure that all the detergent is washed out from the dispenser.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
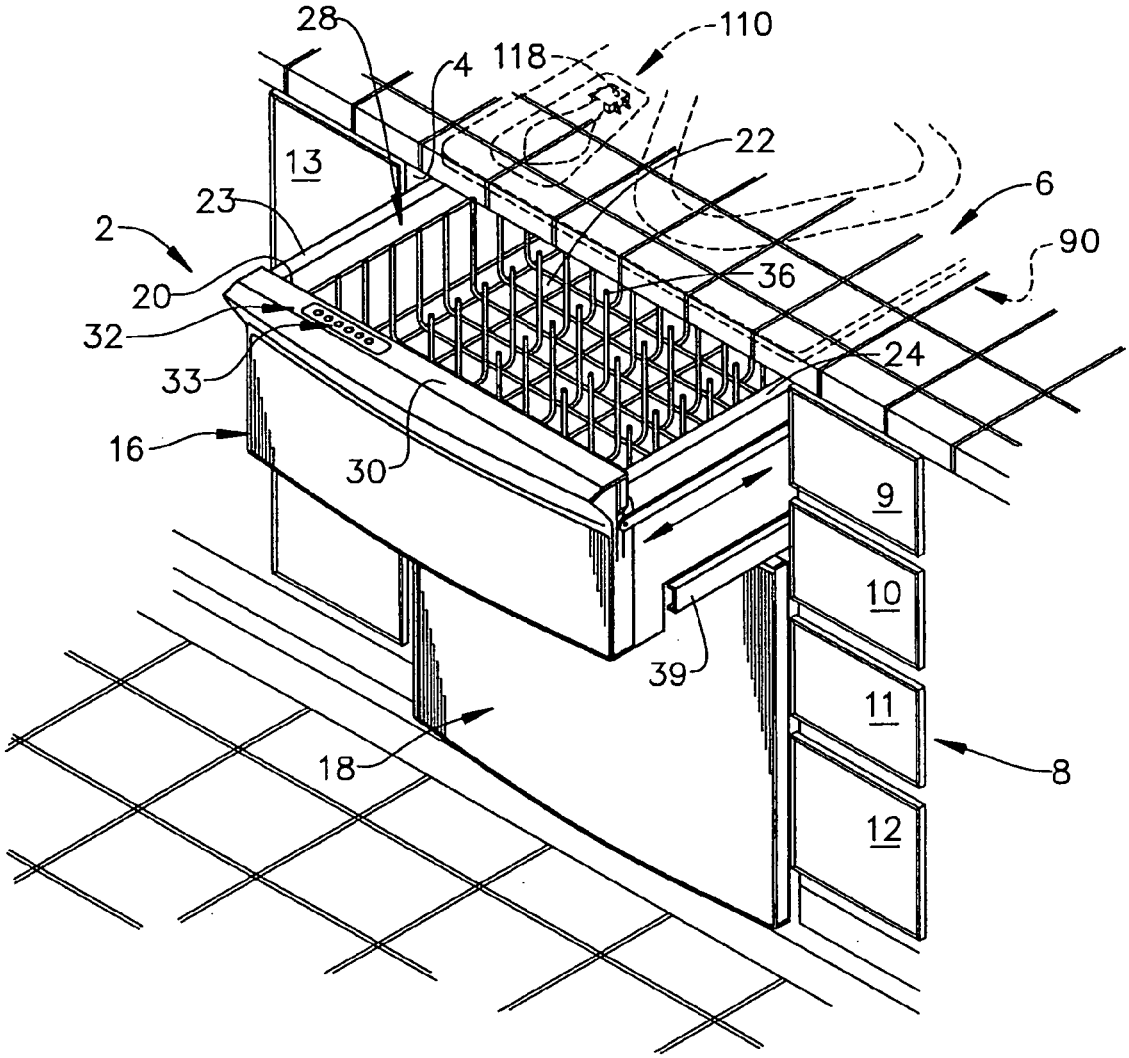
FIG. 1 is an upper right perspective view of a drawer-type dishwasher incorporating a dispenser rinse system constructed in accordance with the present invention.

With initial reference to FIG. 1, a dishwasher constructed in accordance with the present invention is generally indicated at 2. As shown, dishwasher 2 includes an outer support body 4 arranged below a kitchen countertop 6. Also below kitchen countertop 6 is shown cabinetry 8 including a plurality of drawers 9-12, as well as a cabinet door 13. Although the actual dishwasher into which the present invention may be incorporated can vary, the invention is shown in connection with dishwasher 2 depicted as a dual cavity dishwasher having an upper washing unit or tub 16 and a lower washing unit 18. At this point it should be understood that, while lower washing unit 18 is depicted as a conventional-style dishwasher, washing unit 18 could also constitute a drawer-type unit or need not be present such that dishwasher 2 would constituted a single drawer unit.

In accordance with the embodiment shown, tub 16 includes a front wall 20, a rear wall 21, a bottom wall 22 and opposing side walls 23 and 24 that collectively define an upper washing chamber 28. Front wall 20 includes an upper ledge portion 30 provided with a control panel 32 that includes a plurality of control elements 33 for establishing a washing operation in tub 16 (also see FIG. 3). In a manner known in the art, tub 16 is provided with a dishrack 36 for supporting various objects, such as dishware, glassware, and the like during a washing operation in which jets of washing fluid emanating from, for example, a lower wash arm 38 are sprayed about washing chamber 28. In a manner also known in the art, tub 16 is slidingly supported within outer support body 4 through a pair of extensible glides, one of which is indicated at 39.

Figure 2:
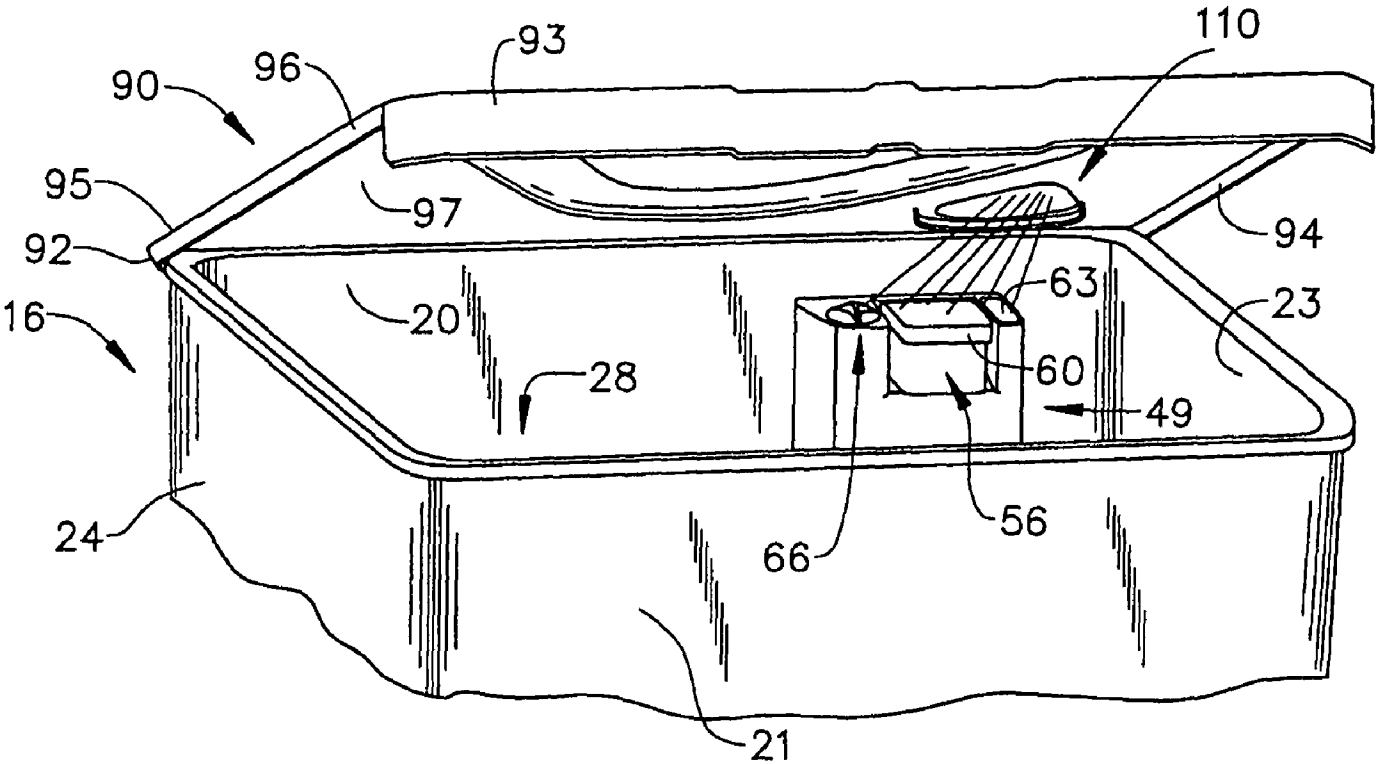
FIG. 2 is a rear perspective view of a washing chamber portion of the dishwasher shown in FIG. 1, with a lid of the dishwasher tilted upward to illustrate the dispenser rinse system.
Figure 3:
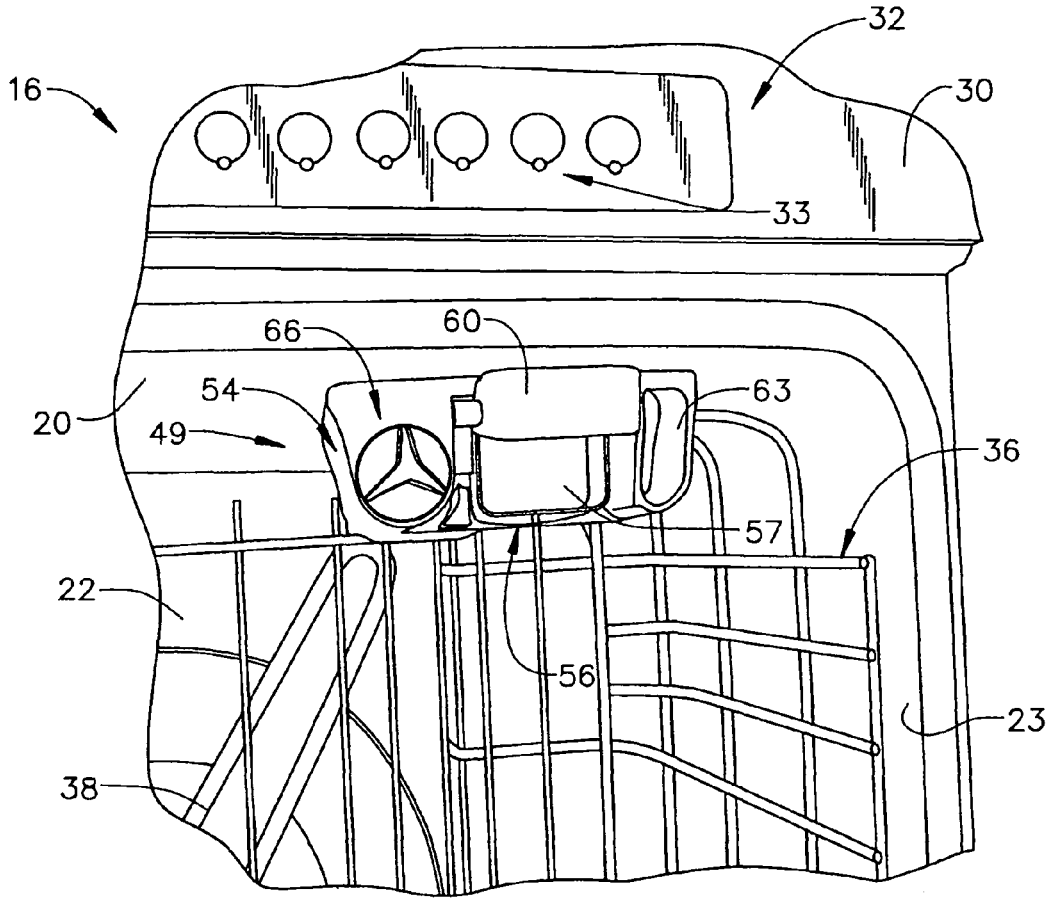
FIG. 3 is an upper perspective view of a dispenser portion of the washing chamber of FIG. 2.

As best shown in FIGS. 2 and 3, dishwasher 2 includes a dispenser 49 having a main body portion 54 that houses a detergent storage portion 56 defined by an interior cavity 57 and a lid 60. Dispenser 49 also includes a pre-wash chamber portion 63 and a rinse aid dispenser portion 66 which are arranged along either side of detergent storage portion 56. Pre-wash chamber portion 63 enables a consumer to place an amount of detergent in dishwasher 2 for a pre-wash function. The pre-wash function mixes water with detergent in pre-wash chamber portion 63 to perform an initial wash before lid 60 is opened to expose interior cavity 57 and detergent contained therein during a main wash portion of a washing operation. Also, rinse aid dispenser 66 selectively releases a rinse aid product during a rinse portion of the washing operation to minimize any water spots from remaining on dishware following the washing operation.

Dishwasher 2 also includes a lid 90 that is shiftably mounted relative to tub 16 so as to selectively close washing chamber 28. Towards that end, lid 90 is shown to include a front edge portion 92, a rear edge portion 93 and opposing side edge portions 94 and 95 that collectively define an upper surface portion 96 and a lower surface portion 97. At this point, it should be understood that lid 90 is shown pivoted about front edge portion 92 in FIG. 2 to provide a view of washing chamber 28. In actuality, lid 90 generally shifts vertically, through operation of a lifting mechanism (not shown), to cover and/or expose washing chamber 28. However, as the lifting mechanism does not form part of the present invention, a detailed description will not be provided herein. Instead, it should be recognized that various types of lifting mechanisms known in the art could be employed to operate lid 90.

Figure 4:
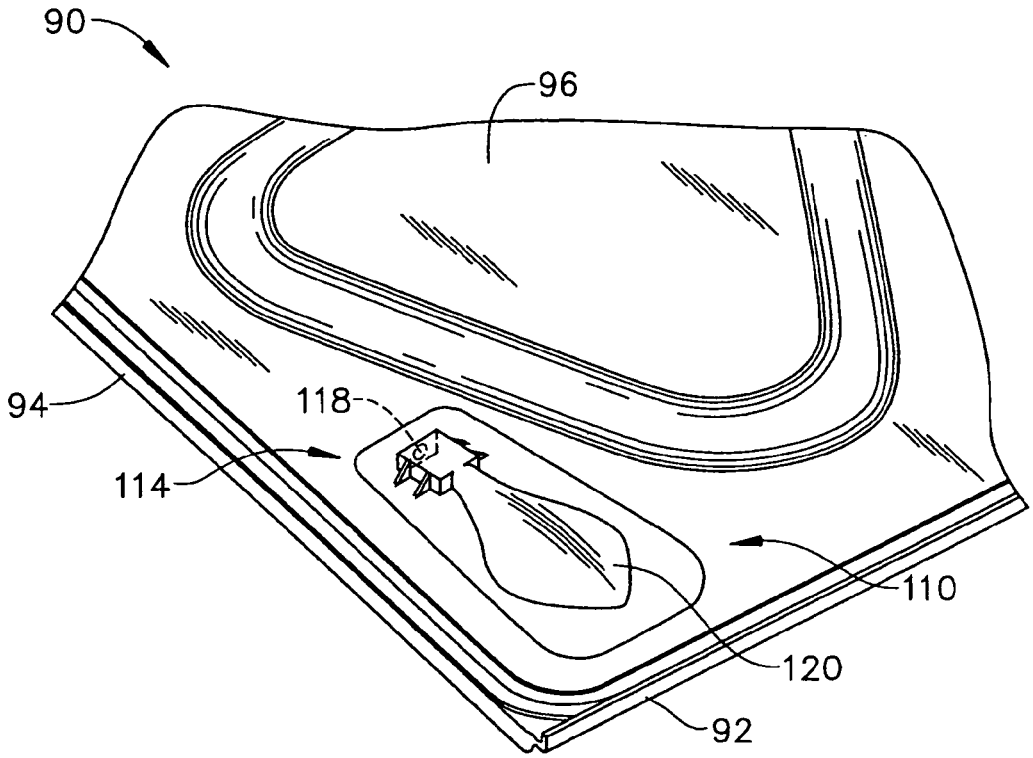
FIG. 4 is an partial view of an upper surface of the lid of FIG. 2 illustrating an inlet portion of the dispenser rinse system.
Figure 5:
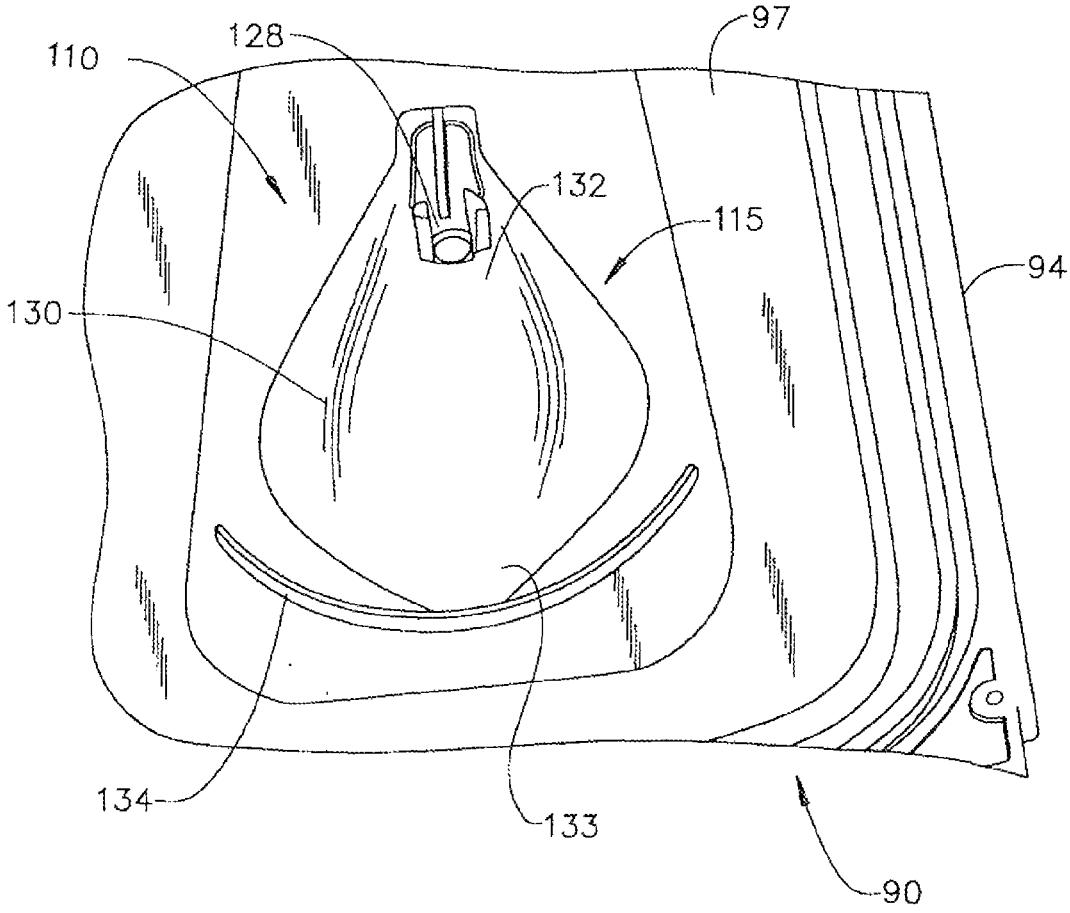
FIG. 5 an partial view of a lower surface of the lid of FIG. 2 illustrating an outlet portion of the dispenser rinse system.

In accordance with the invention, dishwasher 2 is provided with a dispenser rinse system 110 that is mounted to lid 90. Dispenser rinse system 110 directs a flow of water onto dispenser 49 when filling washing chamber 28. In this manner, the flow of water washes out any detergent that is present in pre-wash chamber 63 and detergent storage portion 56 when lid 60 is opened. As best shown in FIGS. 4 and 5, dispenser rinse system 110 includes an inlet portion 114 provided on upper surface portion 96 of lid 90 and an outlet portion 115 that is formed in lower surface portion 97. Inlet portion 114 preferably includes an inlet 118 that is adapted to connect to a water feed conduit (not shown) that is hooked to a supply of water. Inlet 118 leads to a convex-shaped guide section 120 which protrudes upward from outer surface 96.

In further accordance with the most preferred form of the invention, outlet portion 115 includes an outlet or nozzle 128 that is in fluid communication with inlet 118 and a contoured guide section 130 having a first or narrow end 132 positioned adjacent inlet 118 which extends to a second or flared end 133. Contoured guide section 130 is actually concave in shape such that water flowing through outlet 128 is guided slightly downward onto dispenser 49. Actually, contoured guide section 130 is established by convex-shaped guide section 120. Dispenser rinse system 110 further includes a curvilinear wall 134 that extends downward form lower surface portion 97 and is positioned adjacent second end 133. Curvilinear wall 134 distributes water flowing along contoured guide section 130 so as to substantially cover dispenser 49 as discussed further below.

With this construction, during a fill operation, water initially enters washing chamber 28 through outlet 128. The water is guided over contoured guide section 130, impacts wall 134 and sprays onto dispenser 49. During a pre-wash portion of a washing operation, the water emanating from dispenser rinse system 110 washes out detergent, if any, from pre-wash chamber portion 63. During a main wash portion, lid 60 is opened to expose interior cavity 57 of detergent storage portion 56. Water emanating from dispenser rinse system 110 during this point of the washing operation washes out detergent storage portion 56. In either case, the water mixes with the detergent to form a washing liquid which is sprayed about washing chamber 28 to wash any dishware on dishrack 36. At this point, it should be understood that the present invention provides for a low cost, easy to manufacture system for washing out a dispenser mounted in a drawer-type dishwasher. More specifically, the present invention ensures that any detergent remaining within dispenser 49 is removed so as to ensure proper washing of dishware within washing chamber 28. By providing outlet portion 115 in lid 90 rather than tub 16, routing of water lines is greatly simplified and substantially less prone to leaking. In addition, the shape of contoured guide section 130 provides a simple, easily constructed, device for dispersing the water flowing from outlet 128 so as to completely cover dispenser 49 such that the addition of curvilinear wall 134 is an option which serves to further ensure a larger diffusion of water for more complete coverage of dispenser 49.

Although described with reference to a preferred embodiment of the invention, it should be readily understood that various changes and/or modifications can be made to the invention without departing from the spirit thereof. For instance, while the dispenser is shown mounted on front wall 20, various other locations could also be employed so long as the dispenser rinse system is aimed accordingly. In general, the invention is only intended to be limited by the scope of the following claims.

We claim:

1. A drawer-type dishwasher comprising:

an outer support body;

a tub slidingly supported in the outer support body, said tub including front, rear, bottom and opposing side walls that collectively define a washing chamber;

a dispenser mounted to one of the front, rear and opposing side walls, said dispenser including a detergent storage portion that is selectively exposed to release detergent into the washing chamber during a washing operation;

a lid shiftably mounted relative to the tub for selectively closing the washing chamber for the washing operation, said lid including front, rear and opposing side edge portions that define an upper surface portion and a lower surface portion; and a dispenser rinse system provided on the lid, said dispenser rinse system including an inlet portion and an outlet portion, said outlet portion guiding a flow of water from the lid onto the dispenser to wash out the detergent storage portion.

2. The drawer-type dishwasher according to claim 1, wherein the dispenser rinse system fills the washing chamber for the washing operation.

3. The drawer-type dishwasher according to claim 1, wherein the inlet portion includes an inlet provided on the upper surface portion of the lid, said inlet being adapted to receive a flow of water.

4. The drawer-type dishwasher according to claim 3, wherein the outlet portion is provided on the lower surface portion of the lid.

5. The drawer-type dishwasher according to claim 4, wherein the outlet portion includes outlet in fluid communication with the inlet.

6. The drawer-type dishwasher according to claim 1, wherein the outlet portion includes a contoured guide section formed in the lower surface portion of the lid, said contoured guide section being adapted to guide the flow of water downward onto the dispenser.

7. The drawer-type dishwasher according to claim 6, wherein the contoured guide section is concave in shape.

8. The drawer-type dishwasher according to claim 6, wherein the contoured guide section includes a first, narrow end that extends to a second, flared end.

9. The drawer-type dishwasher according to claim 8, further comprising: a wall extending from the lower surface portion of the lid, said wall being positioned adjacent the second end of the contoured guide section to further direct the flow of water onto the dispenser.

10. The drawer-type dishwasher according to claim 9, wherein the wall is curvilinear so as to extend about a portion of the second end of the contoured guide section.

11. The drawer-type dishwasher according to claim 1, wherein the dispenser is mounted to the front wall of the tub.

* * * * *